US006357574B1

(12) United States Patent
Eberle et al.

(10) Patent No.: US 6,357,574 B1
(45) Date of Patent: Mar. 19, 2002

(54) CONVEYOR MEANS

(75) Inventors: Jürg Eberle, Hinwil; Willy Leu, Pfäffikon, both of (CH)

(73) Assignee: Contact GmbH (CH)

( * ) Notice: Subject to any disclaimer, the term of this patent is extended or adjusted under 35 U.S.C. 154(b) by 0 days.

(21) Appl. No.: 09/554,546

(22) PCT Filed: Dec. 9, 1998

(86) PCT No.: PCT/CH98/00524

§ 371 Date: May 12, 2000

§ 102(e) Date: May 12, 2000

(87) PCT Pub. No.: WO99/33731

PCT Pub. Date: Jul. 8, 1999

(30) Foreign Application Priority Data

Dec. 23, 1997 (CH) ..... 2963/97

(51) Int. Cl.[7] ..... B65G 29/00

(52) U.S. Cl. ..... 198/465.4; 198/687.1

(58) Field of Search ..... 198/465.4, 687.1, 198/679, 867.13, 867.14, 805, 690.1, 681, 80.2, 799, 619, 620

(56) References Cited

U.S. PATENT DOCUMENTS 2,824,638 A * 2/1958 Burgh ..... 198/841
4,039,182 A 8/1977 Reist et al. ..... 271/64
4,742,906 A * 5/1988 Wallaart ..... 198/805
4,766,993 A * 8/1988 Kita et al. ..... 198/619
4,892,186 A 1/1990 Frei ..... 198/803.01
5,007,624 A 4/1991 Chandhoke ..... 270/52
5,664,659 A * 9/1997 Gaetner ..... 198/360
5,819,906 A * 10/1998 Enderlein et al. ..... 198/687.1
5,890,583 A * 4/1999 Garbagnati ..... 198/805
6,085,896 A * 7/2000 van Zijdereld ..... 198/841
6,102,191 A * 8/2000 Janzen et al. ..... 198/698.1
6,155,406 A * 12/2000 Garbagnati ..... 198/805
6,170,642 B1 * 1/2001 Galan et al. ..... 198/678.1

* cited by examiner

*Primary Examiner*—Robert J. Oberleitner
*Assistant Examiner*—Benjamin A. Pezzlo
(74) *Attorney, Agent, or Firm*—Brinks Hofer Gilson & Lione

(57) ABSTRACT

The invention relates to a conveyor system comprising a guiding rail (6) and a plurality of retaining devices (8) for a conveyed item, especially printing products. Said retaining devices each have a guiding pan (5) which can individually move in the guiding rail (6). A second guiding rail (7) is provided with a driving means (2) which is guided thereon. The driving means (2) permits a detachable coupling to a coupling part of the guiding part (5) such that, in a coupled state, a load carrying connection exists between the driving means (2) and the coupling part.

16 Claims, 8 Drawing Sheets

Fig.2
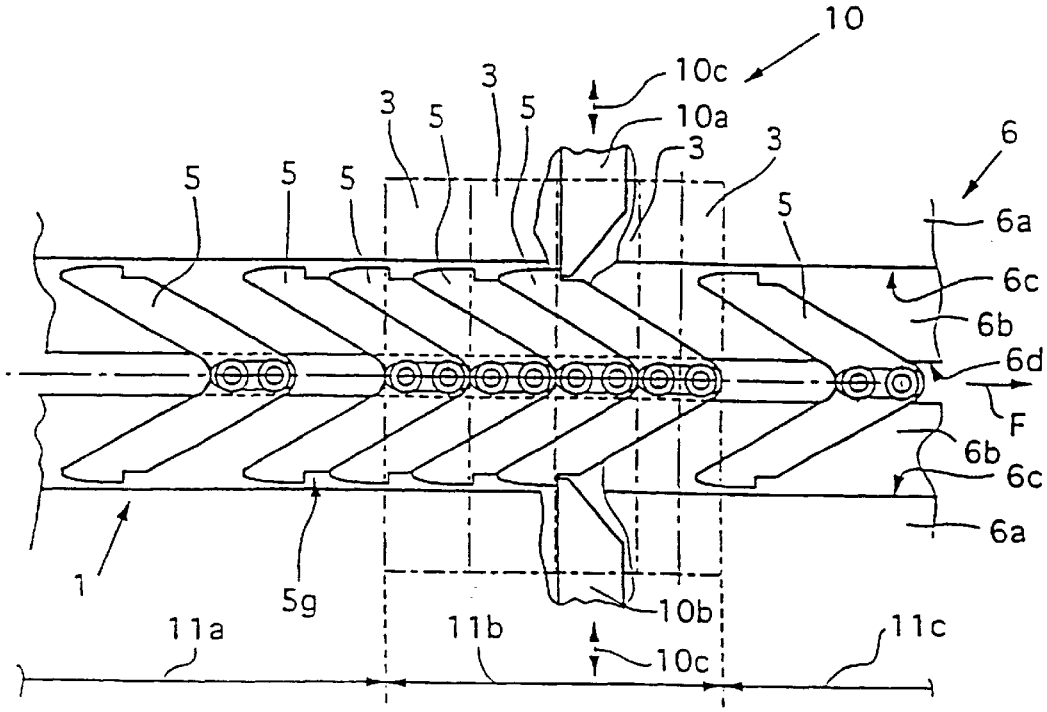
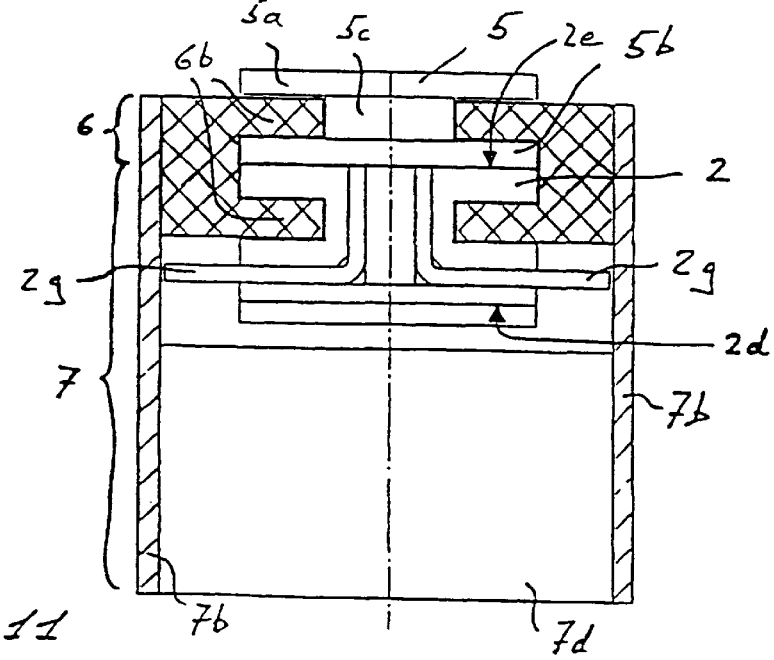
Fig. 11

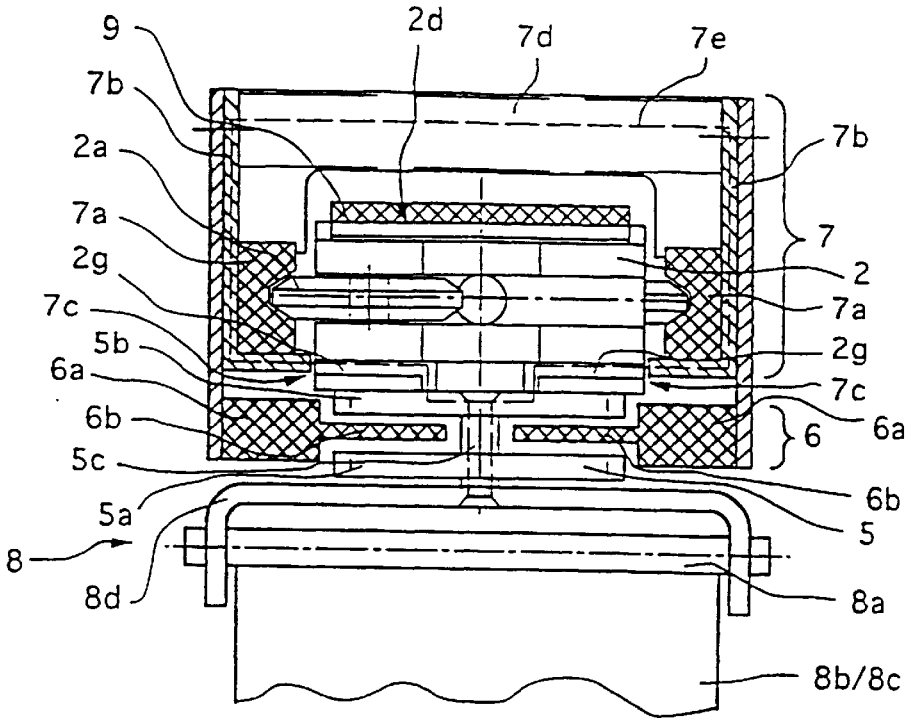
Fig.5
Fig.6
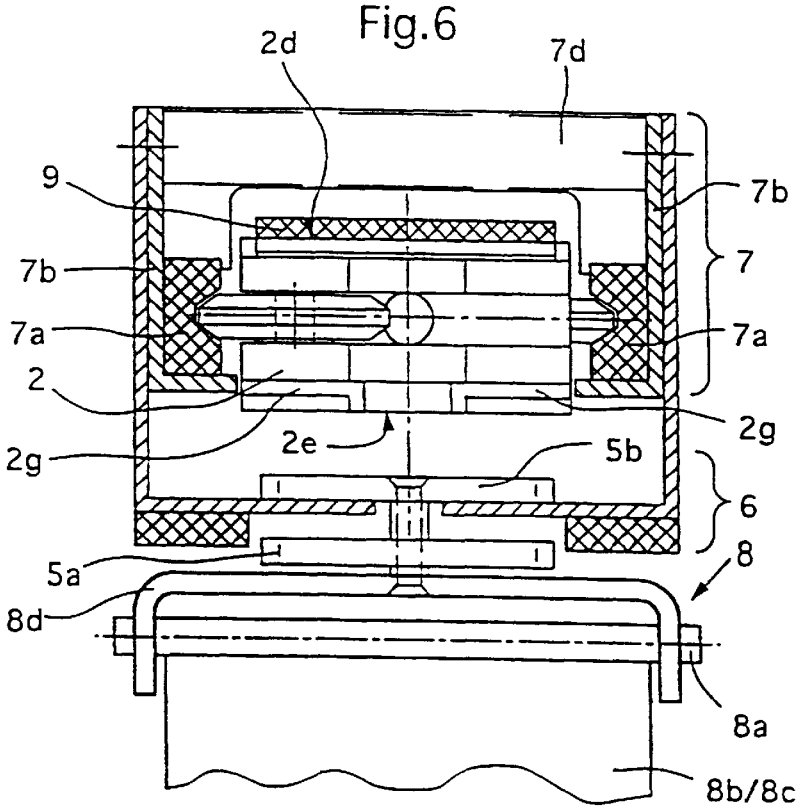

Fig.7d
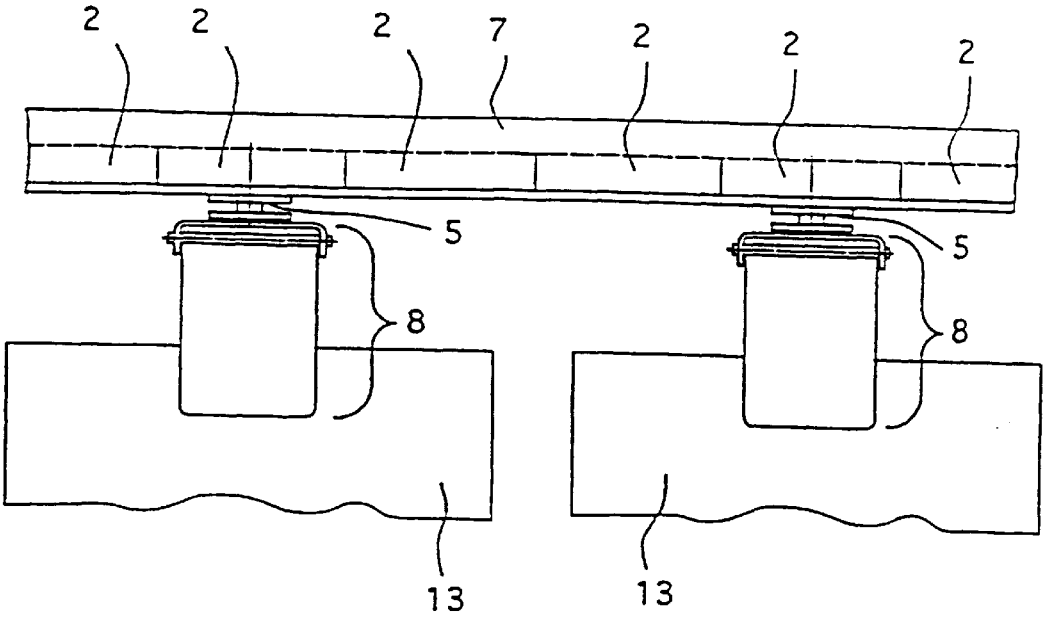
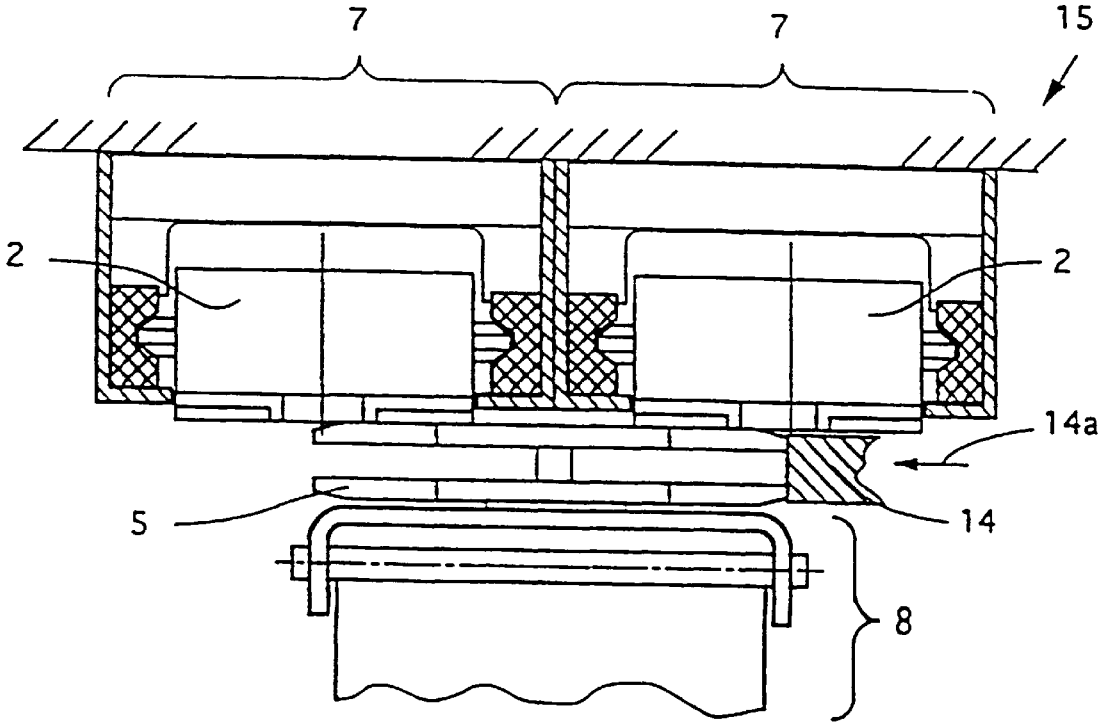
Fig.10

CONVEYOR MEANS

The invention relates to a conveying system according to the preamble of claim 1. The invention also relates to a method of conveying a conveyable article according to the preamble of claim 16.

CH 569 197 A5 discloses an apparatus which uses clamping tongs guided on a rail for the purpose of gripping and retaining printed products arriving, in particular, in imbricated form. Said clamping tongs include the design feature that they protrude virtually to no extent at all in relation to the thickness of the (non-clamped) newspaper and thus find space both in the imbricated formation and (with constant space requirements) in a stack and, furthermore, are of such a low weight that—if necessary—they may be borne and retained by the newspaper itself.

The disadvantage with these known clamping tongs is the fact that they can only be conveyed to very poor effect along a rail, in particular if the clamping tongs rest on the rail. In addition, these clamping tongs do not allow high conveying speeds, as are necessary in the case of modern installations which process, for example, printed products and are capable of conveying, for example, 40,000 printed products per hour.

A further disadvantage of the known clamping tongs is the fact that a rotary movement is necessary for the purpose of gripping a printed product, which, on the one hand, requires a correspondingly high-outlay apparatus for the purpose of producing a rotary movement and, on the other hand, needs a relatively long period of time for reliable gripping.

An object of the invention is to develop a conveying system for a conveyable article, in particular for printed products, such that the conveyable article can be conveyed quickly, flexibly and, in particular, at a high density.

This object is achieved by a conveying system having the features of claim 1. Subclaims 2 to 16 relate to further, advantageous configurations of the conveying system. The object is also achieved by a method of conveying a conveyable article having the features of claim 16.

The object is achieved, in particular, by a conveying system comprising a guide rail and a multiplicity of retaining means with in each case one guide part which can be moved individually in the guide rail, it being the case that a second guide rail with a drive means guided thereon is provided, and it being the case that the drive means allows releasable coupling to a coupling part of the guide part such that, in the coupled state, there is a load-bearing connection between the drive means and the coupling part.

In the following description of the conveying system according to the invention, the example consistently used for a conveyable article conveyed by the retaining means is a printed product, for example a newspaper or a periodical. However, this is to be understood merely as an example of a conveyable article. Of course, the same conveying system is also suitable for manipulating and conveying articles other than printed products, for example empty or filled packs, parts of files, books, pieces of luggage, etc. Rather than being able to convey just sheet-like articles, it is possible for articles of all types and shapes to be conveyed. For this purpose, the conveying system has to be designed in adaptation to the forces acting on it and the retaining means has to be configured in adaptation to the shape of the article which is to be conveyed.

The conveying system according to the invention has a large number of advantages.

The guide part with coupling part is fixed to a retaining means. These parts may be configured so as to be very small, very short in the conveying direction, and, in addition, lightweight and cost-effective. In particular for the purpose of conveying printed products, it is necessary to have a multiplicity of such guide parts with retaining means, which can be cost-effectively mass-produced. The separation of the guide part and drive means makes it possible for the drive means, which is guided on the second guide rail, to be configured so as to be sturdy, powerful and possibly also heavy, whereas the guide part may be configured so as to be very small and lightweight.

The very short configuration of the guide part, as seen in the conveying direction, permits a high-density conveying stream of printed products, which, in addition, makes it possible to reduce, if appropriate, the conveying speed of the printed products. In one embodiment, the guide part with retaining means may be configured such that it takes up approximately the same width as a printed product. By virtue of guide parts arranged one after the other on a guide rail and each having a printed product retained in the retaining means, it is possible for these to be "stacked" in a vertical position. This arrangement is suitable, in particular, as an intermediate store of printed products in the [sic] the guide rail is arranged so as to run, for example, on the ceiling of a building, and said ceiling area may thus be used as an intermediate store for printed products. This guide rail may have a slight downward slope, with the result that the guide parts can be moved by the gravitational force acting on them and there is thus no need for any drive means. This means that just one guide rail is required for an intermediate store, with the result that an intermediate store can be produced very cost-effectively.

The two guide rails are arranged one above the other along a conveying path and form two separate conveying streams. While the drive means is preferably constantly circulating, the guide part with retaining means can be coupled to the drive means preferably at any desired point in time and at any desired location. The conveying stream can convey any desired number of printed products up to a maximum possible conveying density.

In the coupled state, there is a load-bearing connection between the drive means and the guide part, with the result that the guide part is guided solely by the drive means. This allows quick, reliable and low-wear conveying a [sic] guide means with retaining means and printed product.

The guide rails may run as desired, even three-dimensionally, in space. In addition, it is possible to provide diverters and transfer locations in order to transfer a guide means from one guide rails [sic] to another. In one embodiment, the conveying system according to the invention allows "individual transportation of printed products" in the [sic], for example, each printed product can be conveyed along a different, predeterminable conveying path. For this purpose, each retaining means and/or each guide means may have an individual code for the purpose of identifying the retaining means individually or in order to predetermine an individual conveying path. During the conveying process, the retaining means can grip printed products or let them go, with the result that it is possible to put together any desired stack of different printed products, for example to put together a stack of printed products, each retained by a single retaining means, which is coordinated individually with the requirements of a recipient.

The guide part is advantageously configured as a slider which, in particular, with large-surface-area configuration, slides on a guide rail having flat-surface rail parts. A slider of V-shaped and wide-legged configuration is stable in relation to tilting, very lightweight and, in addition, can be moved on the guide rail without canting, even with relatively large moments acting thereon. In addition, the slider may be configured so as to be very short as seen in the conveying direction. The V-shaped sliders may form, in a state in which they butt against one another, a type of bar comprising individual sliders, which imparts a high level of positional stability to the sliders, which are in contact with one another. The sliders may be conveyed by being pushed along from the rear. With a downward slope, the sliders may slide of their own accord on the guide rail as a result of the gravitational force acting on them.

In a preferred embodiment, the guide part is coupled to the drive means by a magnetic circuit which causes a force of attraction between the drive means and the guide part. This load-bearing connection may also be achieved using a large number of other means, for example using pneumatically acting means, or using a releasable adhesively bonding means or mechanically, e.g. using a touch-and-close fastener.

The conveying system according to the invention is ideal for conveying bulk goods since is makes it possible to convey a large number of goods such as printed products, in addition at a high density and at high speed, it being possible to achieve, on account of the high possible density of the printed products conveyed, a high conveying capacity even at a low conveying speed. A high packing density of printed products arranged one behind the other on a rail is possible in a stack or intermediate store.

The invention is explained hereinbelow, by way of a number of exemplary embodiments, with reference to the drawings, in which:

FIG. 2 shows a plan view of a plurality of sliders arranged one behind the other on a second guide rail;

FIG. 5 shows a cross section through a first and a second guide rail with drive means, slider and retaining means;

FIG. 6 shows a cross section through a first and a second guide rail with drive means, slider and retaining means, the slider having been released from the drive means;

Figure 7A:
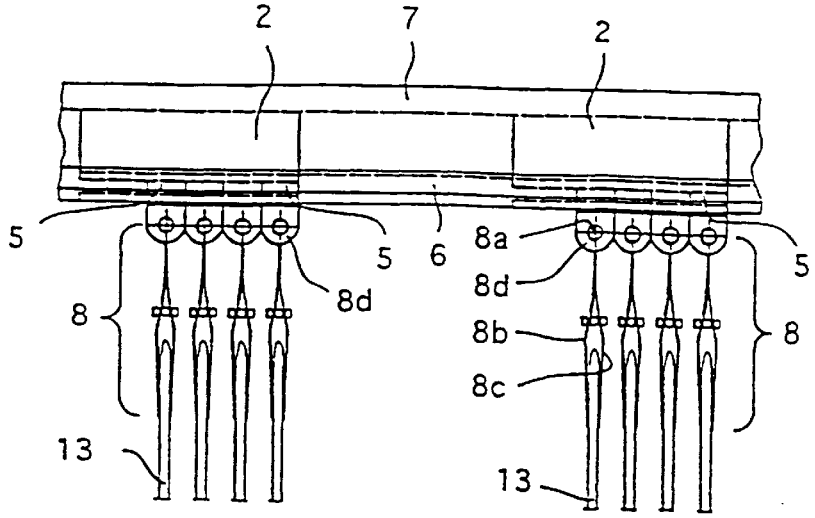
Figure 7B:
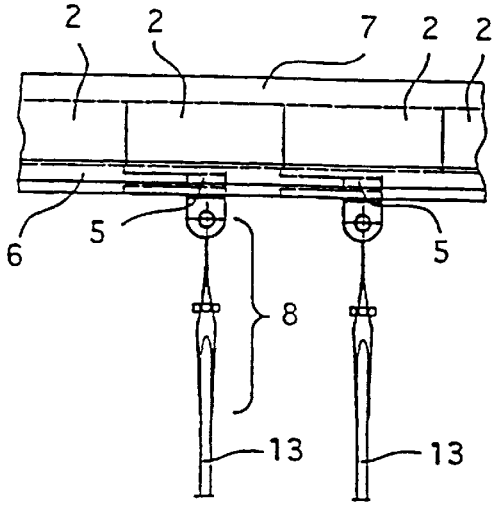
Figure 7C:
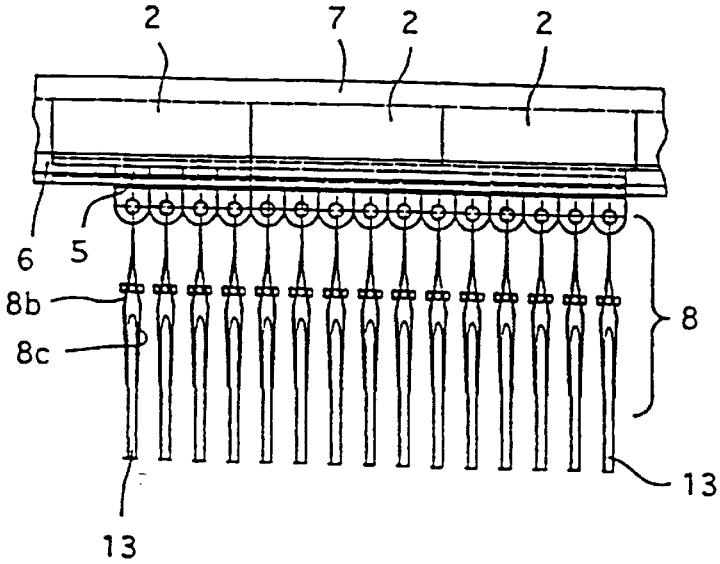
Figure 8:
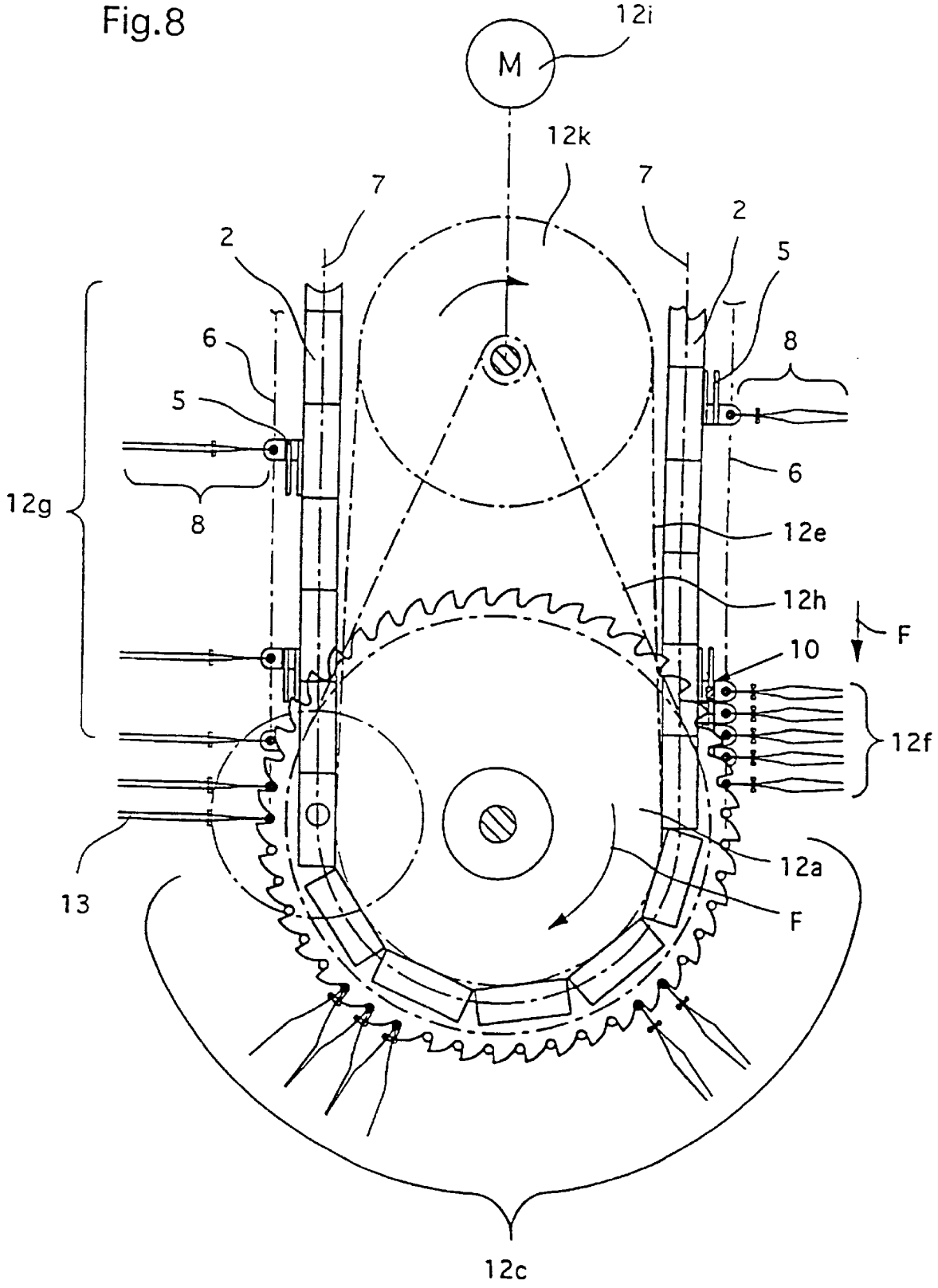
Figure 9A:
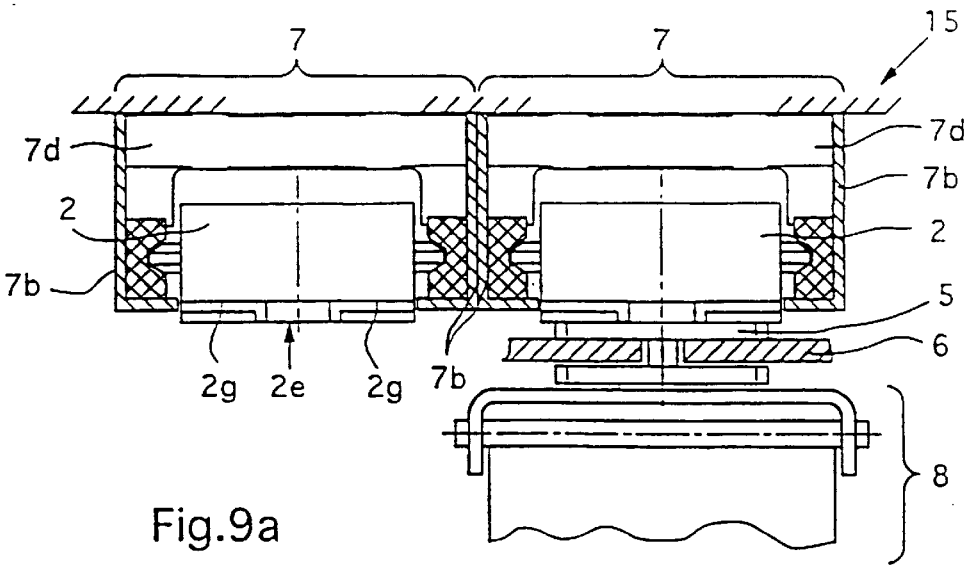
Figure 9B:
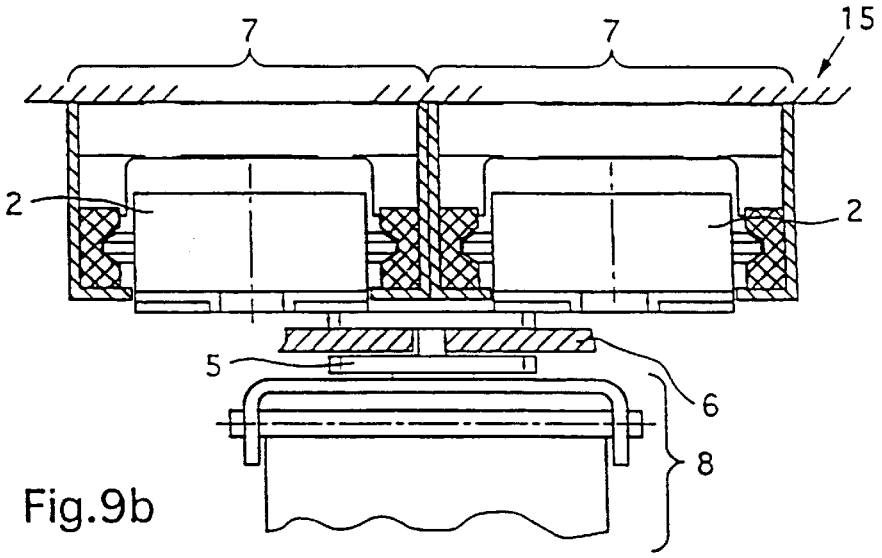
Figure 9C:
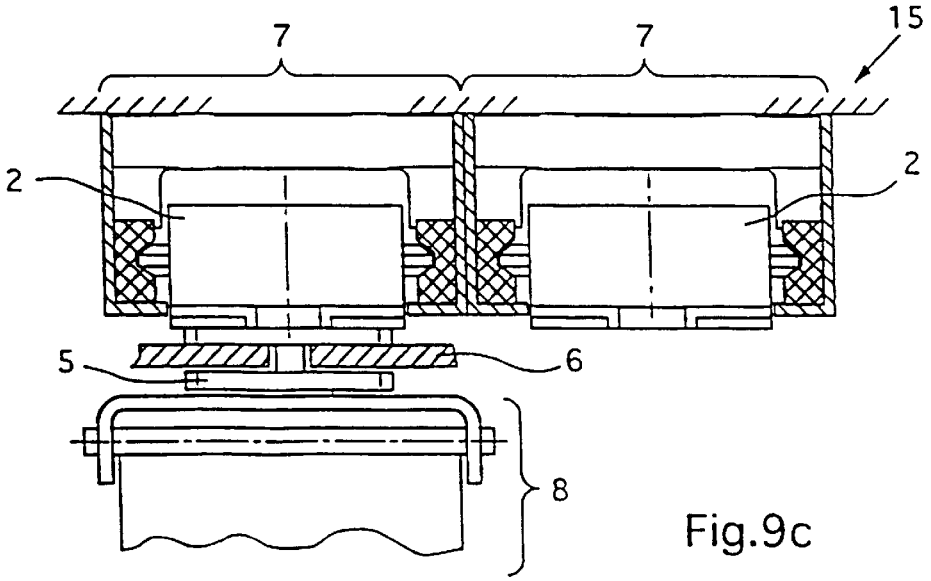

FIGS. 7*a*, 7*b*, 7*c* show a side view of a plurality of drive means, sliders and retaining means arranged differently one behind the other;

FIG. 7*d* shows a side view of a plurality of drive means and sliders with retaining means rotated through 90 degrees;

FIG. 8 shows a deflecting apparatus;

FIGS. 9*a*, 9*b*, 9*c* show a transfer location with a slider and retaining means in different positions;

FIG. 10 shows a further embodiment of a transfer location;

FIG. 11 shows a cross section through a further embodiment of a first and second guide rail with drive means and slider.

Figure 1:
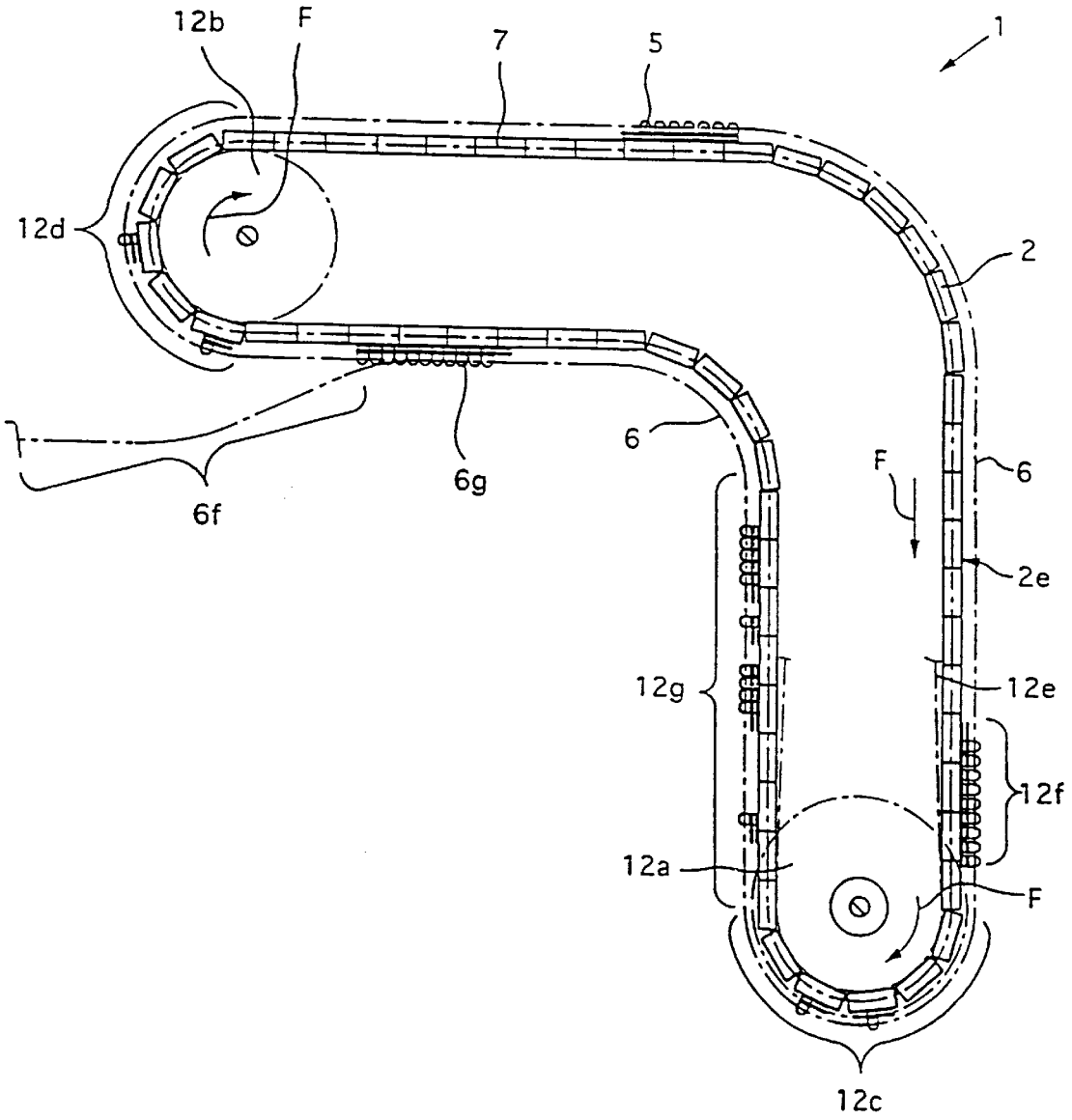
FIG. 1 shows, symbolically, a conveying system with a pair of guide rails which follow a continuous, closed path.

FIG. 1 shows, symbolically, a conveying system 1 which comprises a symbolically illustrated first guide rail 6 on which guide parts 5 are mounted such that they can be moved individually in the conveying direction F and are guided around a continuous, closed path. Running parallel to the first guide rail 6 is a second, symbolically illustrated guide rail 7, which determines the running direction of drive means 2 guided thereon. The drive means 2 comprises a multiplicity of pressure-activated bodies which are arranged one behind the other in the conveying direction F, are in contact with one another at end sides and are mounted in the guide rail 7 with sliding or rolling action. These pressure-activated bodies come into operative connection with the two deflecting wheels 12*a*, 12*b*, with the result that the pressure-activated bodies are deflected and driven in the conveying direction F. Preferred embodiments of such deflecting apparatuses, and pressure-activated bodies adapted thereto, are disclosed in CH Patent Application No. 1997 2964/97 (Representative's reference A12206CH) by the same applicant, said application being filed on the same day and having the title "Fördereinrichtung und entsprechendes Transportmittel" [Conveying apparatus and corresponding transporting means]. The pressure-activated bodies butt against one another in the buffer section 12*f* upstream of the deflecting wheel 12*a*, it being the case that, in said buffer section 12*f*, a toothed belt 12*e* comes into engagement with the respective pressure-activated bodies and conveys the pressure-activated bodies, relieving the same of pressure, around the rail section 12*c* without said bodies coming into contact with one another, it being the case that, in the end part of the rail section 12*c*, the pressure-activated bodies come into contact with one another again and, subjected to pressure, are pushed up along the conveying section 12*g*. The resulting pushing forces suffice in order to push the pressure-activated bodies, butting against one another, as far as the deflection wheel 12*b*, where, relieved of pressure again, said bodies are conveyed around the rail section 12*d*.

The conveying system 1 thus comprises two parallel, rail-guided part-systems, namely a multiplicity of guide parts 5, which can be moved individually and are guided on and along the first guide rail 6, and an endless chain of bodies 2 which can be moved individually, can be driven in a state in which they butt against one another via end sides 2*b*, 2*c*, can be subjected to pressure, are guided on and along the second guide rail 7 and can be driven by the interaction with deflecting wheels 12*a*, 12*b* and/or with toothed belt 12*e*. The part-system comprising the second guide rail 7, the deflecting wheels 12*a*, 12*b* and drive means 2 is usually constantly on the move, with the result that the drive means 2 are constantly circulating. According to the invention, the guide parts 5 can be coupled to the drive means 2 and released therefrom again, with the result that guide parts 5 can be conveyed in the conveying direction F in a controllable manner, individually or in group formation. Each guide part 5 comprises a coupling part 5*b* via which each guide part 5 can be coupled to the drive means 2, a load-bearing connection being formed in the process, and can be separated from the drive means 2. In the buffer section 12*f*, the guide parts 5 are not coupled to the drive means 2, and are directed around the rail section 12*c* in a controllable manner and, toward the end of the rail section 12*c* at the latest, are coupled to the drive means 2, with the result that the guide parts 5, as is illustrated in the conveying section 12*g*, are conveyed in the upward direction. The first and second guide rails 6, 7, the guide part 5 and the drive means 2 are preferably configured in adaptation to one another so as to produce in the coupled state, between the drive means 2 and the guide part 5, a load-bearing connection such that, during the conveying operation, there is no contact between the first guide rail 6 and the guide part 5. This means that the guide part 5 is guided and retained solely by the drive means 2 during the driven conveying operation.

In addition, the guide rail 6 may have one or more diverters 6*g* in order to form a branching-off or incoming rail section 6*f*. Said rail section 6*f* is designed in accordance with the first guide rail 6, but does not have any drive means 2, with the result that the guide parts 5 slide on the guide rail 6 and, on account of the gravitational force acting on them, are driven passively in the running direction of the rail section 6*f*.

Retaining means 8 (not illustrated) for the purpose of gripping and conveying printed products 13 are usually arranged on the guide part 5. The conveying system 1 allows the guide parts 5 with retaining means 8 to be routed in a freely selectable manner, even three-dimensionally in space.

FIG. 2 shows a plan view of a plurality of guide parts 5 which are arranged one behind the other on the first guide rail 6 and are configured as rail-guidable sliders 5. Preferred embodiments of such sliders, and guide rails adapted thereto, are disclosed in CH Patent Application No. 1997 2962/97 (Representative's reference A12204CH) by the same applicant, said application being filed on the same day and having the title "Schienenführbares Fördermittel und F ührungsschiene zum Führen des Fördermittels" [Rail-guidable conveying means and guide rail for guiding the conveying means].

The first guide rail 6 comprises two rail parts 6*b* which are spaced apart from one another to form a gap 6*d*. This gap 6*d* forms a first guide for the slider 5 and defines the conveying direction F of the same. The slider forms a guide part 5 which runs in the form of a V in the conveying direction F and is of H-shaped configuration in a plane normal to the conveying direction F, as can be seen from FIG. 5. The guide part 5 comprises two V-shaped sliding bodies 5*a*, 5*b* which are spaced apart perpendicularly to the conveying direction F and are connected by a crosspiece 5*c*. In the exemplary embodiment illustrated, the sliding bodies 5*a*, 5*b* are configured and arranged so as to be congruent. The only difference between the two sliding bodies 5*a*, 5*b* is that the top sliding body 5*a* has, on both sides, a notch 5*g* which is arranged in the end region and is intended for the engagement of a restraining finger 10*a* of a stop and release device 10. It would also be possible for the two sliding bodies 5*a*, 5*b* to be configured differently from one another and to have different lengths, for example, in the conveying direction F.

The sliding bodies 5*a*, 5*b* are spaced apart from one another such that the rail part 6*b* is located between them with an amount of play. The V-shaped configuration of the sliding bodies 5*a*, 5*b* allows those surfaces of the latter which are directed toward the first guide rail 6 to be configured so as to have relatively large surface areas, with the result that the sliding body 5*a*, 5*b* can rest and slide on the rail 6 such that it is supported over a large surface area, which allows sliding on the rail 6 with low friction.

The crosspiece 5*c* of the guide part 5 has two lateral sliding surfaces which run in the conveying direction F and are guided in the gap 6*d* of the first guide rail 6.

Each sliding body 5*a*, 5*b* has two side arms which together form the V-shaped configuration, each of the side arms having a leading edge and a trailing edge in relation to the conveying direction F. In the exemplary embodiment illustrated, the two edges are configured so as to run parallel to one another or virtually parallel to one another. This configuration has the advantage that sliders 5 in contact with one another, as is illustrated by the buffer region 11*b*, are supported against one another such that they form a type of bar and the sliders 5 are thus retained firmly relative to one another, with the result that, in this position, relative movement only takes place with difficulty.

In the end region, the side arms of the sliders 5 form a side surface which is configured so as to run approximately parallel to a sliding surface 6*c* of the first guide rail 6. Said side surface 5*f* serves for supporting the slider 5 on the sliding surface 6*c* of the rail 6. The guide parts 6*a*, which provide a second guide, as can be seen from FIG. 5, form part of the first guide rail 6. This configuration of slider 5 and first guide rail 6 guides the slider 5 in the conveying direction F, and forms on [sic] a three-point mounting in the process such that the slider 5 is always mounted in a tilting-free manner at least at three points of the guide rail 6 and, in addition, has a certain amount of play in relation to the guide rail 6 such that, in the state in which it is coupled firmly to the drive means 2, the slider 5 can be conveyed without coming into contact with the guide rail 6. The sliders 5 are configured so as to be very short in the conveying direction F, with the result that a dense conveying stream of sliders 5 is possible.

FIG. 2 shows a plurality of sliders 5 arranged one behind the other on the rail 6. For the sake of clarity, it is only the sliders 5 which are illustrated in full, whereas the retaining means 8 and carrying parts 3, which are fixed to the sliders 5, are only illustrated partially, by dashed lines. FIG. 2 also shows a stop and release device 10 which comprises two restraining fingers 10*a*, 10*b* which can be displaced in the movement direction 10*c* and engage in the notch 5*g* of the slider 5 in order to retain and release a slider 5 in a controllable manner. This stop and release device 10 can restrain the guide parts 5, with the result that the guide parts 5 are in contact with one another in the conveying direction F and form a buffer region 11*b* over a length section of the rail 6. Located upstream of the buffer region 11*b* is an inlet region 11*a*, within which a guide part 5 advances toward the buffer region 11*b* in a freely movable manner. Arranged downstream of the buffer region 11 [sic] is a further region 11*c*, within which the guide part [sic] 5, preferably spaced apart from one another, move in the conveying direction F again.

As can be seen from FIG. 7*a*, it is possible to fasten on each guide part 5 a retaining means 8 which comprises, for example, a bracket 8*d*, an articulation 8*a* and two spreadable tongues 8*b*, 8*c*, which are preferably configured such that the conveyed products [sic], for example a printed product 13, is retained such that it runs perpendicularly, or approximately perpendicularly, to the conveying direction F.

Figure 3:
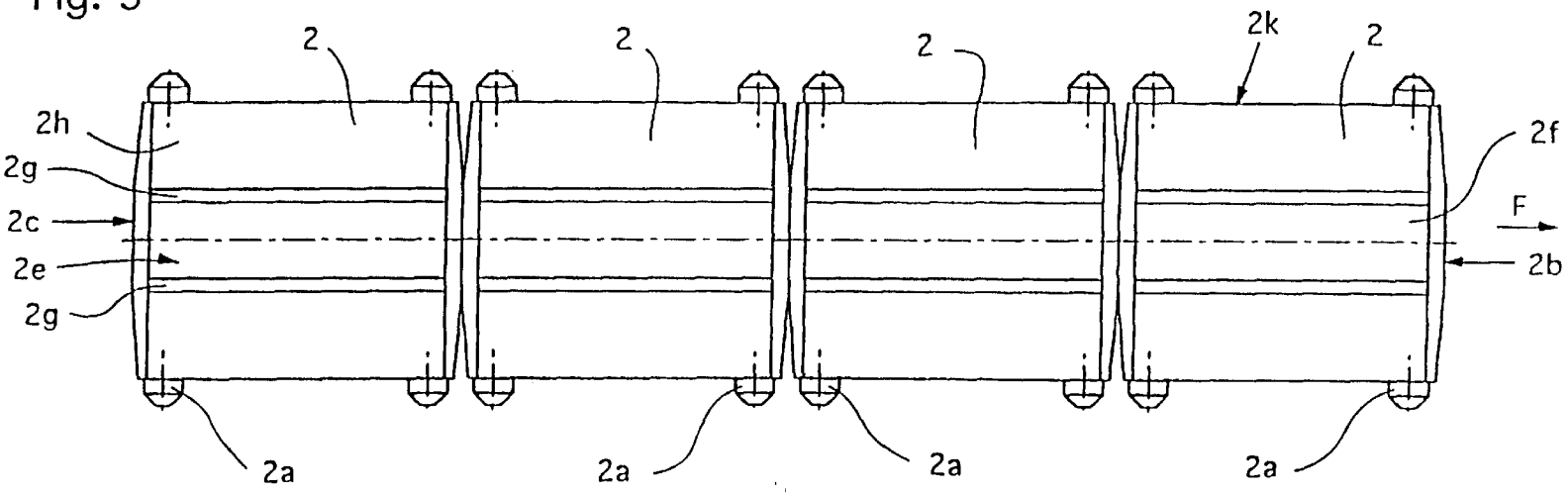
FIG. 3 shows a chain of abutting drive means.

FIG. 3 shows a plan view of a plurality of cuboidal basic bodies 2 which butt against one another on the respective end sides 2*b*, 2*c* in the conveying direction F and can be subjected to pressure, each basic body having four projecting stubs 2*a* which serve as guide means in order to guide the basic bodies 2 in the second guide rail 7. These basic bodies 2, which are driven in a state in which they butt against one another, form the drive means 2, which serves for driving the guide parts 5.

Figure 4:
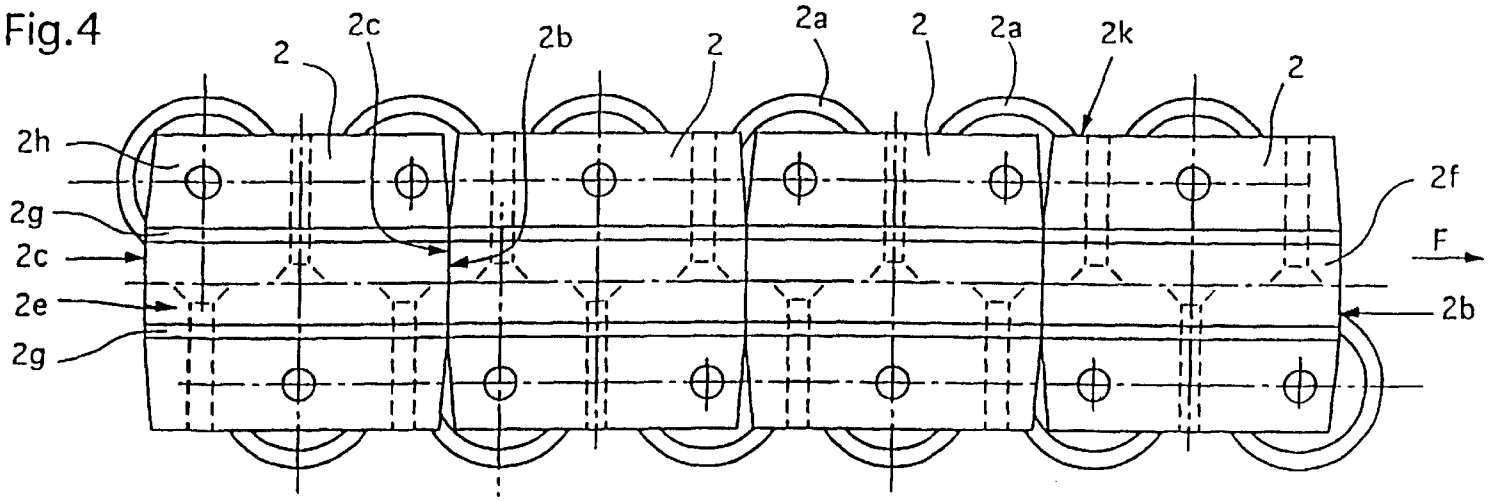
FIG. 4 shows a chain of a further embodiment of abutting drive means.

FIG. 4 shows a plan view of a further exemplary embodiment of a drive means 2. This drive means 2, once again provided with a cuboidal basic body, has guide means 2*a* configured as wheels, with the result that the drive means 2 comprises a chain of individual carriages which butt against one another via end surfaces 2*b*, 2*c* and, as is illustrated in FIG. 5, are guided in the rail body 7*a* of the second guide rail 7. The basic body has an engagement side 2*d*, in which a toothed belt 9 engages, and a load side 2*e*, to which the guide part 5 can be coupled. In addition, the basic body has recesses which are intended for the purpose of receiving the wheels 2*a*. The wheels 2*a* project beyond the guide side 2*k* and, on that guide side 2*k* in which two wheels are spaced apart in the conveying direction F, also project beyond the end sides 2*b*, 2*c*. The view according to FIG. 5 shows the end side 2*c* of an individual carriage 2, there being provided in the basic body, on the right alongside the wheel 2*a*, a recess which is intended for the purpose of receiving the wheel 2*a* projecting beyond the end side 2*b*, 2*c* of an adjacent transporting means 2. In the case of that chain of transporting means 2 butting alongside one another in the conveying direction F which is illustrated in FIG. 4, in each case two adjacent transporting means 2 have been rotated through 180° in relation to one another about the axis formed by the conveying direction F, with the result that the wheel 2*a* projecting in each case beyond the end side 2*b*, 2*c* of one transporting means 2 comes to rest in the recess of the adjacent transporting means 2. This makes possible a chain of transporting means 2 which are conveyed by compressive forces acting via the end sides 2*b*, 2*c*, which are in contact with one another. The transporting means 2 illustrated, with three guide means 2*a* configured as wheels, runs very well in the guide rail 4. It is also possible, on account of the relatively large distance between the individual wheels 2*a*, for torques acting via the load side 2*e* to be transmitted reliably to the second guide rail 7 without causing the transporting means 2 to cant. The convexly running end sides 2*b*, 2*c*, rather than allowing the transporting means 2 to be conveyed merely in a rectilinear manner in the conveying direction F, also allow slightly curved paths, the curvature of said curved path running about an axis located perpendicularly to the viewing direction. The chain of transporting means 2 forms, once again, the drive means , the transporting means 2 providing a type of bar comprising individual links.

In the conveying system 1 according to FIG. 1, the transporting means 2 are deflected about an axis running perpendicularly to the conveying direction F and perpendicularly to the viewing plane, in particular on the deflecting wheels 12*a*, 12*b*. In order to avoid contact between the transporting means 2 in the curved section 12*c*, and in order to permit deflection with a relatively small radius of curvature, the carriages are configured so as to be correspondingly short in the conveying direction F, the transporting means 2 have a relatively large wheel-to-wheel distance.

Each transporting means 2 has a planar, flat-surface load side 2*e* for the coupling of the sliding body 5*b*, which forms a coupling part 5*b* at the same time, it being the case that, as is illustrated in FIG. 3 and FIG. 4, a plurality of transporting means 2, in contact with one another, form a load surface which runs in the conveying direction F and comprises a plurality of load sides 2*e*, it being the case that said load surface have [sic] no interspace between the transporting means 2 in the center and a very narrow interspace between the transporting means 2 in each case in the direction of the border. This configuration of the individual load sides 2*e* makes it possible to form a continuous, flat, preferably planar load surface which is formed from a plurality of transporting means 2, which results in the essential advantage of it being possible for the guide part 5 to be coupled to a transporting means 2 irrespective of the position of the latter in each case, it also being possible for the point in time at which the engagement takes place to be determined freely. As a result, the two conveying streams formed by the guide parts 5 and the drive means 2 may be considered as being independent of one another since the guide part 5 can be coupled to the drive means 2 at any desired location and at any desired point in time.

FIG. 5 shows a cross section through the first and second guide rails 6, 7 with an arrangement for the releasable coupling of the guide part 5 to the drive means 2. Preferred embodiments of such coupling and conveying apparatuses, and pressure-activated bodies adapated thereto, are disclosed in CH Patent Application No. 1997 2965/97 (Representative's reference A12207CH) by the same applicant, said application being filed on the same day and having the title "Fördereinrichtung" [Conveying apparatus].

The second guide rail 7, of u-shaped configuration, has a rail body 7*a* with grooves which are configured in the form of a V on the mutually opposite side surfaces and serve for guiding the wheels 2*a* or pins 2*a* of the drive means 2. The second guide rail 7 defines a conveying direction F, in which, in the cross section illustrated, the drive means 2 is conveyed in a driven manner via a toothed belt 9 which engages in a form-fitting manner. Arranged on both sides of the second guide rail 7 is a flux-concentrating member 7*b* and, therebetween, a permanent magnet 7*d*. The two flux-concentrating members 7*b* are of L-shaped configuration and are fixed to the second guide rail 7.

The drive means 2, configured as a carriage, has a basic body made of a non-ferromagnetic material, for example made of aluminum or a plastic. Arranged on said basic body are two L-shaped, spaced-apart, ferromagnetic flux-concentrating parts 2*g*, of which one end opens out onto the load side 2*e* and the other end is arranged opposite the flux-concentrating members 7*b*, an air gap 7*c* being formed in the process. For the purpose of forming a planar, flat-surface load side 2*e*, the two ferromagnetic parts 2*g* are covered over by a covering part made of a non-ferromagnetic material, with the result that the two ferromagnetic parts 2*g* open out at the load side 2*e* without projecting beyond the surface. The flux-concentrating member 7*b*, the magnet 7*d* and the flux-concentrating parts 2*g* as well as the air gap 7*c* form a magnetic circuit 7*e*. The coupling part 5*b* is configured as a ferromagnetic armature part which closes the magnetic flux circuit 7*e*, this causing a magnetically produced force of attraction Fm between the drive means 2 and the coupling part 5*b*. The coupling part 5*b* is coupled to the drive means 2 in a load-bearing manner, a retaining means 8 being arranged on the guide part 5, which is fixed to the coupling part 5*b*.

In the exemplary embodiment according to FIG. 5, the magnetic circuit 7*e* is arranged such that the lines of flux, in the air gap 7*c*, run perpendicularly to the magnetic force Fm produced. This arrangement has the advantage that the magnetic force Fm is produced between the drive means 2 and the coupling part 5*b*, which serves as armature part, with the result that the wheels 2*a* are not subjected to any direct loading by the force Fm. In the region of the air gap 7*c*, the flux-concentrating members 7*b* are configured so as to run parallel in the conveying direction F, with the result that, for a drive means 2, the sum of the width of the two air gaps 7*c* remains constant, even if, on account of inaccuracies present, the drive means 2 moves back and forth slightly in a horizontal direction. A plurality of magnets 7*d* may be arranged on the second guide rail 7 so as to be spaced apart in the conveying direction F, with the result that there is always a magnetic flux 7*e* present in the conveying direction F, in order to bring about a load-bearing connection between the guide part 5 and the drive means 2.

Arranged beneath the second guide rail 7 is the first guide rail 6, which is configured so as to run parallel to the second guide rail 7. This first guide rail 6 comprises two rail parts 6*b* with side parts 6*a*, the first guide rail 6 being fixed to the second guide rail 7. The rail part 6*b* with side part 6*a* is produced from a non-ferromagnetic material, for example from aluminum or a plastic.

In the exemplary embodiment according to FIG. 5, the first guide rail 6 is configured such that in the state illustrated, in which the guide part 5 is coupled firmly to the drive means 2 by the magnetically acting forces, there is no contact between the guide part 5 and the first guide rail 6, this rendering the first guide rail 6 unnecessary. A sufficiently large amount of play is provided between the guide part 5 and the first guide rail 6 for this purpose. The guide rail 5 is arranged such that it hangs at the bottom of the drive means 2, and it is connected to a retaining means 8 which comprises a bracket 8*d*, an articulation 8*a* and two tongues 8*b*, 8*c*. The magnetic force Fm to which the guide part 5 is subjected by the drive means 2 via the magnetic circuit 7*e* suffices in order to couple the retaining means 8 firmly to the drive means 2. This embodiment is suitable, in particular, for the purpose of conveying lightweight, sheet-like printed products.

It is possible to see, from the cross section according to FIG. 6, the increase in distance, in relation to FIG. 5, between the first guide rail 6 and the second guide rail 7. The guide part 5 is no longer retained by the drive means 2, but rather rests on the first guide rail 6 by way of the sliding body 5*b* such that it can be moved in the conveying direction F.

FIG. 7*a* shows a side view of two guide rails 6, 7 which are arranged one above the other and run parallel in the conveying direction F. Two individual carriages 2, which are spaced apart in the conveying direction F, each have four coupled guide parts 5, on which in each case one retaining means 8 is arranged. The guide parts 5 are coupled firmly to the individual carriages and are retained without coming into contact with the first guide rail 6. This means that the guide parts 5 with retaining means 8 can be conveyed in the conveying direction F very quickly and without frictional losses and with low wear. FIG. 7*b* shows a side view of the same arrangement of the guide rails 6, 7, the individual carriages 2, which are in contact with one another, forming a drive means 2. Each guide part 5 is connected to a single individual carriage 2. FIG. 7*c*, like FIG. 7*b*, shows individual carriages 2 which are in contact with one another, and to which a multiplicity of guide parts 5 which are in contact with one another are coupled. FIG. 7*c* shows the highest possible conveying density of printed products 13 in the conveying direction F. The guide parts 5 are butting against one another, with the result that it is not possible to have any higher density in the conveying direction F. FIG. 7*d*, like FIG. 7*b* and FIG. 7*c*, shows individual carriages 2 which are in contact with one another and form a drive means 2. In relation to the conveying operations according to FIGS. 7*a*, 7*b*, 7*c*, the retaining means 8 are arranged in a state in which they have been pivoted through 90 degrees, with the result that the printed products 13 are conveyed with a surface running parallel to the conveying direction F.

FIG. 8 shows, in detail, the deflecting apparatus 12*a*, which is illustrated at the bottom in FIG. 1. The drive means 2 are guided on the second guide rail 7 and, upstream of the region of the deflecting section 12*c*, come into engagement with a toothed belt 12*e* which engages on the engagement side 2*d*. In the deflecting section, as outlined in FIG. 1, the individual carriages 2 are deflected without coming into contact with one another. The guide parts 5 with retaining means 8 are guided along the first guide rail 6. That section of the guide rails 6, 7 which comes from the top right has no magnetic circuit, with the result that the guide parts 5, rather than being coupled to the drive means 2, are guided solely on the first guide rail 6, drop downward as a result of the gravitational force acting on them and run onto the guide parts 5 located in the buffer section 12*f*. A release device 10 allows the guide parts 5 to be retained and discharged to the following deflecting wheel 12*a* in a controlled manner. The guide parts 5 are also guided on the first guide rail 6 in the curved rail section 12*c*. The toothed deflecting wheel 12*a* is configured such that each tooth is capable of conveying a single guide part 5 around the rail section 12*c*. The guide parts 5 are not coupled to the drive means 2 within the rail section 12*c*. The coupling to the drive means 2 takes place at the end of the rail section 12*c*, where the guide parts 5 are coupled to the drive means 2 again and are conveyed in the upward direction in conveying section 12*g* by the drive means 2. A motor 12*i* drives a deflecting roller 12*k* and, synchronously with one another, the toothed belts 12*e*, 12*h*.

FIGS. 9*a*, 9*b*, 9*c* show a transfer location 15 at which two second guide rails 7, running parallel alongside one another, are arranged. The conveying direction F of the guide part 5 takes place [sic] perpendicularly in the direction of the viewing plane. In FIG. 9*a*, the first guide rail 6 runs beneath the right-hand second guide rail 7, the first guide rail 6 following an S-shaped course in the conveying direction F. FIG. 9*b* shows the first guide rail 6 positioned in the center of the S-shaped course, whereas FIG. 9*c* illustrates the first guide rail positioned at the end of the S-shaped course, beneath the left-hand second guide rail 7. The guide part 5 rests on the first guide rail 6 and is moved in the conveying direction F by the drive means 2, by way of the magnetically acting forces, this resulting in a change of path from the right-hand to the left-hand guide rail 7. Downstream of the transfer location 15, as seen in the conveying direction F, the guide part 5 is coupled to the drive means 2 again in a load-bearing manner. It would also be possible for the change of path to take place with two second guide rails 7 which are arranged parallel alongside one another and are configured according to FIG. 6, in the [sic] the first guide rail 6 has a slight downward slope at the deflecting [sic] location 15, with the result that, on account of the action of the gravitational force on the first guide rail 6, the guide part 5 is conveyed with sliding action from one guide rail 7 to the adjacent guide rail 7.

FIG. 10 shows a further transfer location 15 with two guide rails 7 arranged parallel alongside one another. The guide part 5 is retained on the drive part 2 by magnetically acting means and is displaced by a transfer device 14 from the right-hand drive means 2 to the left-hand drive means 2. The transfer location 15 could also be configured as a branching section or a diverter, which branches the first guide rail 6, in particular in a controllable manner, in two separate directions.

The conveying system may comprise a multiplicity of first and second guide rails 6, 7 which run in any desired directions and, in addition, may be connected to one another via branching-off sections. In addition, a conveying system may comprise a plurality of second guide rails 7 which are arranged along a continuous path and have drive means 2 in order to convey the guide part 5, which is guided on the first guide rail 6. It is possible in certain sections of the conveying system, as seen in the conveying direction F, for said conveying system only to have a first guide rail 6, which guides the guide part 5, or in certain sections of the conveying system, as seen in the conveying direction F, for said conveying system only to have the second guide rail 7, there being a load-bearing connection between the drive means 2 and the coupling part 5*b* of the guide part 5.

It is also possible for the conveying system to be configured such that each retaining means 8 and/or each guide part 5 has an individual coding, and that at least one sensor is provided for the purpose of sensing the coding, in order to sense, in particular, the location of said retaining means and/or guide part and to control the conveying path which is to be followed thereby.

The cross section according to FIG. 11 shows an exemplary embodiment with a guide part 5 and a drive means 2 which are guided on a common guide rail 6/7. Both the guide part 5 and the drive means 2 are of u-shaped configuration on both sides, with the result that in each case one rail part 6*b* with sliding surfaces suffices for guidance purposes. The drive means 2 comprises two ferromagnetic flux-concentrating parts 2*g* via which the magnetic field produced by the permanent magnet 7*d* is conducted to the guide part 5 via the flux-concentrating members 7*b*. The common guide rail 6/7 can open out into two separate guide rails 6, 7.

What is claimed is:

1. Conveying system (1) comprising a guide rail (6) and a multiplicity of retaining means (8) for a conveyable article, in particular printed products, with in each case one guide part (5) which can be moved individually in the guide rail (6), and also comprising a second guide rail (7) with a drive means (2) guided thereon, characterized in that the drive means (2) allows releasable coupling to a coupling part (5*b*) of the guide part (5) such that, in the coupled state, the guide part (5) is borne at least partially by the drive means (2) in that there is a load-bearing connection between the drive means (2) and the coupling part (5*b*) the guide part (5) being configured as a slider (5) and the first guide rail (6) including a sliding surface (6*b*) configured in adaptation to the slider (5).

2. Conveying system according claim 1, characterized in that the first and the second guide rails (6, 7), at least over part of the length, are arranged parallel to one another and are spaced apart from one another such that a guide part (5) which engages on the first guide rail (6) can be coupled to the drive means (2) at the same time.

3. Conveying system according to claim 2, characterized in that the two guide rails (6, 7) are arranged one above the other.

4. Conveying system according to claim 3, characterized in that the two guide rails (6, 7) are spaced apart from one another, and the slider (5) and the first guide rail (6) are configured in adaptation to one another, such that a slider (5) which is coupled to the drive means (2) can be conveyed without coming into contact with the first guide rail (6).

5. Conveying system according to claim 1, characterized in that the drive means (2) has a flat-surface load side (2*e*) for the coupling of the coupling part (5*b*), and in that a plurality of drive means (2) form a load surface, running in the conveying direction (F) and comprising a plurality of load sides (2*e*), for the purpose of coupling the guide part (5) irrespective of the position of the drive means (2) in each case, the load surface having, in particular, no interspaces or only very narrow interspaces.

6. Conveying system according to claim 1, characterized in that the drive means (2) is configured as a multiplicity of pressure-activated bodies which can be moved individually and can be driven in a state in which they butt against one another via end sides (2*b*, 2*c*).

7. Conveying system according to claim 1, characterized in that the drive means (2) and the guide means (5) each have a length which extends in the conveying direction (F), and in that these two lengths may be dimensioned such that, for each drive means (2), it is possible to couple at least one guide means (5), but in particular a plurality of guide means (5) arranged one behind the other in the conveying direction (F).

8. Conveying system according to claim 1, characterized in that the retaining means (8) are configured for the purpose of retaining a sheet-like conveyable article, in particular a printed product, and are fixed to the guide part (5), such that the sheet-like conveyable article is retained such that it runs approximately perpendicularly to the conveying direction (F).

9. Conveying system according to claim 1, characterized in that in certain sections, as seen in the conveying direction (F), it is only the first guide rail (6), which guides the guide part (5), which is provided, or in that in certain sections, as seen in the conveying direction (F), it is only the second guide rail (7) which is provided, there being a load-bearing connection between the drive means (2) and the coupling part (5*b*) of the guide part (5).

10. Conveying system according to claim 1, characterized by at least one first guide rail (6) and at least one second guide rail (7) with drive means (2), it being the case that, at least at transfer locations (15), the guide rails (6, 7) run parallel to one another, it being the case that the transfer locations (15) are configured such that the guide part (5), which is connected to the drive means (2) of a second guide rail (7) in a load-bearing manner, can be transferred to a first guide rail (6), or in that the guide part (5) can be coupled to a drive means (2) of a second guide rail (7) from a first guide rail (6), or in that the guide part (5) can be transferred from a drive means (2) of a second guide rail (7) to a drive means (2) of a further second guide rail (7) or from a first guide rail (6) to a further first guide rail (6).

11. Conveying system according to claim 1, characterized in that the first guide rail (6) has branching sections, of which the branching direction can be controlled in particular.

12. Conveying system according to claim 1, characterized in that the guide part (5) is coupled to the drive means (2) via magnetic, pneumatic, releasably adhesively bonding or interengaging means.

13. Conveying system according to claim 1, characterized in that the drive means (2) and the guide means (5) have ferromagnetic flux parts (2*g*; 7*b*, 7*d*) which are arranged in adaptation to one another such that a coupling part (5*b*) which butts against the drive means (2) forms a magnetic circuit (7*e*) and is retained by magnetically acting forces.

14. Conveying system according to claim 13, characterized in that a ferromagnetic flux-concentrating member (7*b*) which is arranged firmly in relation to the second guide rail (7) comprises a magnet (7*d*), and in that the flux-concentrating member (7*b*) is arranged in relation to the correspondingly adapted drive means (2) such that the flux-concentrating member (7*b*) forms a magnetic circuit (7*e*) via the drive means (2) and the coupling part (5*b*).

15. Conveying system according to claim 1, characterized in that each retaining means (8) and/or each guide part (5) has an individual coding, and in that at least one sensor is provided for the purpose of sensing the coding, in order to sense, in particular, the location of said retaining means and/or guide part and to control the conveying path which is to be followed thereby.

16. Method of operating a conveying system according to claim 1, characterized in that the conveyed drive means (2) produce a conveying stream which moves in the conveying direction (F) and, in particular, has no interspaces, and in that, on account of this conveying stream, it is possible to produce, between the guide parts (5) with retaining means (8) and the drive means (2), a load-bearing connection which is not dependent on the position of a drive means (2) in each case.

* * * * *